US012644650B2

(12) United States Patent
Ruhl et al.

(10) Patent No.: US 12,644,650 B2
(45) Date of Patent: Jun. 2, 2026

(54) HEAT EXCHANGER WITH A VERTICAL ROD BAFFLE STRUCTURE AND AT LEAST ONE NOTCHED LONGITUDINAL PARTITION PLATE

(71) Applicant: Lummus Novolen Technology GmbH, Mannheim (DE)

(72) Inventors: Oliver Marco Ruhl, Mannheim (DE); Jochen Axel Schwab, Mannheim (DE); Marco Brignone, Mannheim (DE); Frank Fiedler, Mannheim (DE)

(73) Assignee: Lummus Novolen Technology GmbH, Mannheim (DE)

( * ) Notice: Subject to any disclaimer, the term of this patent is extended or adjusted under 35 U.S.C. 154(b) by 367 days.

(21) Appl. No.: 18/041,670

(22) PCT Filed: Aug. 23, 2021

(86) PCT No.: PCT/EP2021/073308
§ 371 (c)(1),
(2) Date: Feb. 14, 2023

(87) PCT Pub. No.: WO2022/038300
PCT Pub. Date: Feb. 24, 2022

(65) Prior Publication Data

US 2023/0314086 A1 Oct. 5, 2023

(30) Foreign Application Priority Data

Aug. 21, 2020 (EP) ..... 20192268

(51) Int. Cl.
*F28D 7/16* (2006.01)
*F28D 7/06* (2006.01)
(Continued)

(52) U.S. Cl.
CPC ..... *F28D 7/1676* (2013.01); *F28D 7/06* (2013.01); *F28F 9/0136* (2013.01); *F28F 2009/224* (2013.01); *F28F 2265/30* (2013.01)

(58) Field of Classification Search
CPC . F28D 7/1676; F28D 7/06; F28D 7/16; F28D 2021/0059; F28F 9/0136; F28F 2009/224; F28F 2265/30; F28F 2225/04
See application file for complete search history.

(56) References Cited

U.S. PATENT DOCUMENTS 1,672,650 A * 6/1928 Lonsdale ..... F28F 9/22 165/DIG. 411
1,683,236 A * 9/1928 Braun ..... F28B 1/00 165/160

(Continued)

FOREIGN PATENT DOCUMENTS

CN 104197751 A 12/2014
CN 106767039 A 5/2017

(Continued)

OTHER PUBLICATIONS

Office Action issued in Japanese Application No. JP2023-512425 mailed on Jun. 4, 2024 (12 pages).

(Continued)

*Primary Examiner* — Ljiljana V. Ciric
(74) *Attorney, Agent, or Firm* — Osha Bergman Watanabe & Burton LLP

(57) ABSTRACT

A vertical rod baffle heat exchanger that includes a shell; a tube-sheet; a tube bundle having a plurality of heat exchange tubes extending in an axial direction; six or more longitudinal partition plates; and a plurality of rod baffle rings provided along an axial length of the plurality of heat exchange tubes. At least one longitudinal partition plate may be a notched longitudinal partition plate. The plurality of rod baffle rings may have lateral rod baffles and longitudinal rod (Continued)

baffles. The lateral rod baffles and the longitudinal rod baffles may pass through gaps between every two adjacent tubes of plurality of heat exchange tubes. The lateral rod baffles may pass through openings in the notched longitudinal partition plate.

13 Claims, 8 Drawing Sheets

(51) Int. Cl.
*F28F 9/013* (2006.01)
*F28F 9/22* (2006.01)

(56) References Cited

U.S. PATENT DOCUMENTS 1,790,828 A * 2/1931 McKnight ..... F28D 7/1646 165/161
1,813,234 A * 7/1931 Dodd ..... F28D 7/1646 165/145
1,848,741 A * 3/1932 Nelson ..... F28F 9/22 165/DIG. 411
1,948,550 A * 2/1934 Voorheis ..... F23K 5/20 165/68
1,962,362 A * 6/1934 Reed ..... F28D 7/087 165/161
2,229,344 A * 1/1941 Schneider ..... F28F 9/26 165/81
3,007,679 A * 11/1961 Byerley ..... F28F 9/22 165/69
3,180,405 A * 4/1965 Nelson ..... F28F 1/36 165/184
3,292,691 A * 12/1966 Welter ..... F28F 9/0132 165/172
3,326,282 A * 6/1967 Jenssen ..... F28D 7/16 165/172
3,366,172 A * 1/1968 Gyorgy ..... F28D 7/1653 165/172
3,420,297 A * 1/1969 Romanos ..... F28D 7/06 165/162
3,600,792 A * 8/1971 Valluy ..... F16L 3/22 165/172
3,820,594 A * 6/1974 Ritland et al. ..... F28F 9/0136 165/172
3,903,964 A * 9/1975 Van Doorn ..... F28F 19/002 165/158
3,958,630 A * 5/1976 Smith ..... F28F 9/22 165/161
3,964,146 A * 6/1976 Vestre ..... F28F 9/0132 165/162
3,967,677 A * 7/1976 Mohlman ..... F28F 9/22 165/162
3,998,268 A * 12/1976 Sagan ..... F28F 9/0132 165/172
4,013,121 A * 3/1977 Berger ..... F28D 7/06 165/162
4,049,048 A * 9/1977 Leedham ..... F28F 1/325 165/DIG. 417
4,105,065 A * 8/1978 Chirico ..... F28F 9/0202 165/137
4,127,165 A * 11/1978 Small ..... F28F 9/0132 165/162
4,136,736 A * 1/1979 Small ..... F28F 9/22 165/162
4,143,709 A * 3/1979 Cunningham ..... F28F 9/0135 165/172
4,204,570 A * 5/1980 Eisinger ..... F28D 7/06 165/172
4,230,527 A * 10/1980 Cella ..... F28F 9/0136 376/371
4,253,516 A * 3/1981 Giardina ..... F22B 37/001 165/81
4,286,366 A * 9/1981 Vinyard ..... F28F 9/0132 165/162
4,413,394 A * 11/1983 Small ..... F28F 9/22 29/428
4,429,739 A * 2/1984 Gentry ..... F22B 37/205 165/162
4,441,550 A * 4/1984 Chase ..... F28D 7/06 165/145
4,579,304 A * 4/1986 Williams ..... F28F 9/0136 165/172
4,595,161 A * 6/1986 Williams ..... F28F 9/0136 248/68.1
4,640,342 A * 2/1987 Appleman ..... F28F 9/0132 165/69
4,720,840 A * 1/1988 Lagally ..... F28F 9/0132 165/69
4,732,585 A * 3/1988 Lerner ..... F28F 13/06 261/153
4,789,028 A * 12/1988 Gowda ..... F22B 37/206 29/523
4,796,695 A * 1/1989 Cannon ..... F28D 7/16 165/162
4,823,866 A * 4/1989 Hunt ..... F28F 13/125 248/68.1
4,828,021 A * 5/1989 Small ..... F28F 9/0132 165/162
4,858,681 A * 8/1989 Sulzberger ..... F28D 7/1638 165/184
4,893,671 A * 1/1990 Lagally ..... F28F 9/0132 29/890.051
4,972,903 A * 11/1990 Kwok ..... F28D 7/06 165/158
5,033,542 A * 7/1991 Jabs ..... F28D 7/06 165/DIG. 426
5,101,892 A * 4/1992 Takeuchi ..... F28F 9/182 165/173
5,291,944 A * 3/1994 Sanz ..... F28D 7/1669 165/910
5,323,849 A * 6/1994 Korczynski, Jr. ..... F28F 11/00 165/905
5,355,945 A * 10/1994 Sanz ..... F28F 9/0131 165/910
5,386,073 A * 1/1995 Kwok ..... F28D 7/06 585/723
5,447,191 A * 9/1995 Boula ..... F28F 9/0132 165/69
5,615,738 A * 4/1997 Cameron ..... F28F 27/02 165/DIG. 123
5,642,778 A * 7/1997 Gentry ..... F28F 9/0132 165/910
5,832,991 A * 11/1998 Cesaroni ..... F28F 9/22 165/DIG. 406
6,059,022 A * 5/2000 Wilson ..... F28F 9/0131 165/172
6,116,041 A * 9/2000 Cassell ..... F25B 39/02 62/199
6,513,583 B1 * 2/2003 Hughes ..... F28F 9/0236 165/162
6,808,017 B1 * 10/2004 Kaellis ..... F28F 13/12 165/181
6,827,138 B1 * 12/2004 Master ..... F28D 7/1607 165/162
7,284,598 B2 * 10/2007 Mulder ..... F28F 9/0131 165/172
7,389,811 B2 * 6/2008 Mulder ..... F28F 9/0131 165/172
7,635,456 B2 * 12/2009 Burlingame ..... B01J 8/065 422/204
7,934,301 B2 * 5/2011 Mulder ..... F28F 9/0131 165/172
8,997,841 B2 * 4/2015 Dawson ..... F28G 7/00 165/166
9,534,779 B2 * 1/2017 Wepfer ..... F22B 37/205
9,677,825 B2 * 6/2017 Artamo ..... F28D 7/16
9,951,997 B2 * 4/2018 Maurer ..... F28F 13/003
10,222,139 B2 * 3/2019 Treptow ..... F16L 3/237

(56) References Cited

U.S. PATENT DOCUMENTS

| | | | | |
|---|---|---|---|---|
| 10,295,266 | B2 * | 5/2019 | Singh | F28D 7/1607 |
| 10,371,422 | B2 * | 8/2019 | Moreaux | B01D 1/04 |
| 10,386,120 | B2 * | 8/2019 | Rizzi | F28F 9/001 |
| 10,401,878 | B2 * | 9/2019 | Gromes, Sr. | G05B 15/02 |
| 10,641,480 | B2 * | 5/2020 | Crenn | F22B 37/206 |
| 11,287,196 | B2 * | 3/2022 | Macedo | F28F 9/22 |
| 11,421,938 | B2 * | 8/2022 | Krieger | F28D 7/1607 |
| 11,493,282 | B2 * | 11/2022 | Blokhin | F28F 1/06 |
| 11,536,497 | B2 * | 12/2022 | Kang | F25B 39/02 |
| 11,898,682 | B2 * | 2/2024 | Verma | F16L 57/06 |
| 12,235,057 | B2 * | 2/2025 | Maciunas | F28F 9/0135 |
| 2009/0200004 | A1 * | 8/2009 | Johnston | F28D 7/16 165/172 |
| 2009/0242181 | A1 * | 10/2009 | Wanni | F28F 9/0132 165/162 |
| 2010/0116477 | A1 * | 5/2010 | Mulder | F28F 9/22 29/890.03 |
| 2010/0116478 | A1 * | 5/2010 | Wanni | F28F 9/22 165/162 |
| 2010/0122797 | A1 * | 5/2010 | Seo | F28D 7/1661 165/104.19 |
| 2010/0193167 | A1 * | 8/2010 | Song | F28D 7/16 165/159 |
| 2010/0282450 | A1 * | 11/2010 | Mulder | F28F 9/26 29/890.036 |
| 2012/0199330 | A1 * | 8/2012 | Maurer | F28D 7/1669 165/172 |
| 2014/0262172 | A1 * | 9/2014 | Ljubicic | F28D 7/1684 165/154 |
| 2016/0018168 | A1 * | 1/2016 | Urbanski | F28F 9/22 165/159 |
| 2016/0061441 | A1 * | 3/2016 | Matsubara | F22B 37/205 29/890.051 |
| 2020/0049412 | A1 * | 2/2020 | Rizzi | F28F 9/24 |
| 2022/0338500 | A1 * | 10/2022 | Tanis | F28D 7/1638 |
| 2023/0314086 | A1 * | 10/2023 | Ruhl | F28F 9/0136 165/157 |
| 2023/0314095 | A1 * | 10/2023 | Porro | F28D 7/16 165/162 |
| 2024/0210116 | A1 * | 6/2024 | Manenti | F28F 13/06 |

FOREIGN PATENT DOCUMENTS

| | | | | |
|---|---|---|---|---|
| CS | 269165 | B1 * | 4/1990 | |
| DE | DD-284517 | A5 * | 11/1990 | |
| EP | 2975353 | A1 * | 1/2016 | F28F 9/0131 |
| EP | 4090902 | B1 * | 3/2024 | F28F 9/0131 |
| JP | S53-089871 | U | 7/1978 | |
| JP | S6060492 | A * | 4/1985 | |
| JP | H08145502 | A | 6/1996 | |
| JP | 2011515648 | A | 5/2011 | |
| PL | 112917 | B1 * | 10/1977 | |
| UA | 119176 | C2 * | 5/2019 | F28F 9/0202 |

OTHER PUBLICATIONS

Office Action issued in Japanese Application No. JP2023-512425, mailed on Nov. 26, 2024 (5 pages).

International Preliminary Report on Patentability issued in International Application No. PCT/EP2021/073308 dated Feb. 16, 2023 (7 pages).

International Search Report issued in International Application No. PCT/EP2021/073308 dated Nov. 24, 2021 (3 pages).

Written Opinion issued in International Application No. PCT/EP2021/073308 dated Nov. 24, 2021 (6 pages).

Office Action issued in Columbian Application No. NC2023/0002179, mailed on Apr. 11, 2025 (16 pages).

Office Action issued in Chinese patent application No. 202180051376.3, mailed on Dec. 8, 2025 (9 pages).

* cited by examiner

HEAT EXCHANGER WITH A VERTICAL ROD BAFFLE STRUCTURE AND AT LEAST ONE NOTCHED LONGITUDINAL PARTITION PLATE

FIELD OF DISCLOSURE

Embodiments disclosed herein relate generally to heat exchanger systems. More particularly, embodiments disclosed herein relate to vertical rod baffle heat exchangers for reaction heat removal.

BACKGROUND

Rod baffle heat exchangers were created in 1970 by Philips Petroleum Company to eliminate flow-induced vibrations in a plate baffle heat exchanger. Rod baffle heat exchangers are shell and tube type heat exchangers utilizing rod baffles to support the tubes and secure them against vibrations. Additionally, rod baffles can be used to correct shell-side flow distributions and to create a more turbulent shell-side flow. The term "baffle" refers to an annular ring in which the ends of a plurality of support rods are connected; hence the term "rod baffle". Examples of rod baffle heat exchangers may be found in, for example, U.S. Pat. No. 5,642,778 and Chinese Patent No. 104197751, which are incorporated herein by reference.

As shown in FIG. 1, a conventional rod baffle heat exchanger, such as a shell and tube heat exchanger 10, may include a rod baffle tube bundle 12 surrounded by a shell 14. Tubes 28 in the tube bundle 12 are supported by a plurality of rod baffle assemblies 16, 18, 20, and 22. One fluid enters the shell-side of the shell and tube heat exchanger 10 through an inlet 26 and after heat exchange with the fluid in tubes 28 leaves the shell-side via outlet 30. The fluid flowing through the tube side of the heat exchanger enters the end cap 38 of the heat exchanger via inlet 32 and leaves the end cap 44 of the heat exchanger via outlet 34. Thus, fluid flows from end chamber 36, which is defined by end cap 38 of the heat exchanger 10 and tube sheet 40, through the tubes 28 and into the opposite end chamber 42, which is similarly defined by the end cap 44 and the other tube sheet 46.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a vertical rod baffle heat exchanger that may be used for heat removal, condensation operations, electricity generation, petrochemical plants, waste heat recovery, and other industrial applications. The vertical rod baffle heat exchanger may include a shell; a tube-sheet; a tube bundle having a plurality of heat exchange tubes extending in an axial direction, wherein the tube bundle is a U-tube bundle may have a U-bend in the plurality of heat exchange tubes; six or more longitudinal partition plates, wherein at least one longitudinal partition plate is a notched longitudinal partition plate; and a plurality of rod baffle rings provided along an axial length of the plurality of heat exchange tubes, wherein the plurality of rod baffle rings may have lateral rod baffles and longitudinal rod baffles. The lateral rod baffles and the longitudinal rod baffles may pass through gaps between every two adjacent tubes of plurality of heat exchange tubes, and the lateral rod baffles may pass through openings in the notched longitudinal partition plate. The notched longitudinal partition plates may extend a length in a longitudinal direction to at least a lower end of the U-tube bundle to provide a lower liquid seal. The notched longitudinal partition plates may extend a length in a radial direction to have a notched end of the notched longitudinal partition plates within the U-tube bundle.

In one or more aspects, the vertical rod baffle heat exchanger may further include a plurality of support bars arranged on a circumference of the shell adapted to fix the tube bundle and be a slideway for the plurality of rod baffle rings. The plurality of support bars may be spaced apart from each other and rotated in 90-degree increments around a circumference of the plurality of rod baffle rings. A non-condensable gas outlet may be provided at a similar level close to the tube-sheet on the shell as a vapor inlet. A liquid seal cylindrical section may be provided close to an elbow section on the shell side. An impingement plate may be provided in the shell to distribute incoming vapor from the inlet.

In some aspects, the plurality of rod baffle rings may have a set of four rod baffle rings: a first rod baffle ring having a plurality of lateral rod baffles extending from an inner surface of the first rod baffle ring, a second rod baffle ring having a plurality of longitudinal rod baffles extending from an inner surface of the second rod baffle ring, a third rod baffle ring having a plurality of lateral rod baffles extending from an inner surface of the third rod baffle ring, and a fourth rod baffle ring having a plurality of longitudinal rod baffles extending from an inner surface of the fourth rod baffle ring. The vertical rod baffle heat exchanger may include at least four sets of four rod baffle rings. Additionally, a fifth set of four rod baffle rings may include two of the first rod baffle rings, the third rod baffle ring, and the fourth rod baffle ring. Each of the plurality of rod baffle rings may be evenly spaced a distance from an adjacent rod baffle across a length of the U-tube bundle. Each of the six or more longitudinal partition plates may be a notched longitudinal partition plate. A width of each of the longitudinal partition plates may be between 3 to 9 millimeters.

In yet another aspect, a distance between the longitudinal partition plates and a length of the notched longitudinal partition plates may varied. A distance between a first longitudinal partition plate and a second longitudinal partition plate may be greater than a distance between the second longitudinal partition plate and a third longitudinal partition plate. The distance between the second longitudinal partition plate and the third longitudinal partition plate may be greater than a distance between the third longitudinal partition plate and a fourth longitudinal partition plate. The distance between the third longitudinal partition plate and the fourth longitudinal partition plate may be greater than a distance between the fourth longitudinal partition plate and a fifth longitudinal partition plate. The distance between the fourth longitudinal partition plate and the fifth longitudinal partition plate may be greater than a distance between the fifth longitudinal partition plate and a sixth longitudinal partition plate. The notched end of each notched longitudinal partition plate may be a vertical distance from the shell. The vertical distance of the notched longitudinal partition plates may progressively decrease from the first longitudinal partition plate to the sixth longitudinal partition plate.

Other aspects and advantages will be apparent from the following description and the appended claims.

DETAILED DESCRIPTION

Figure 1:
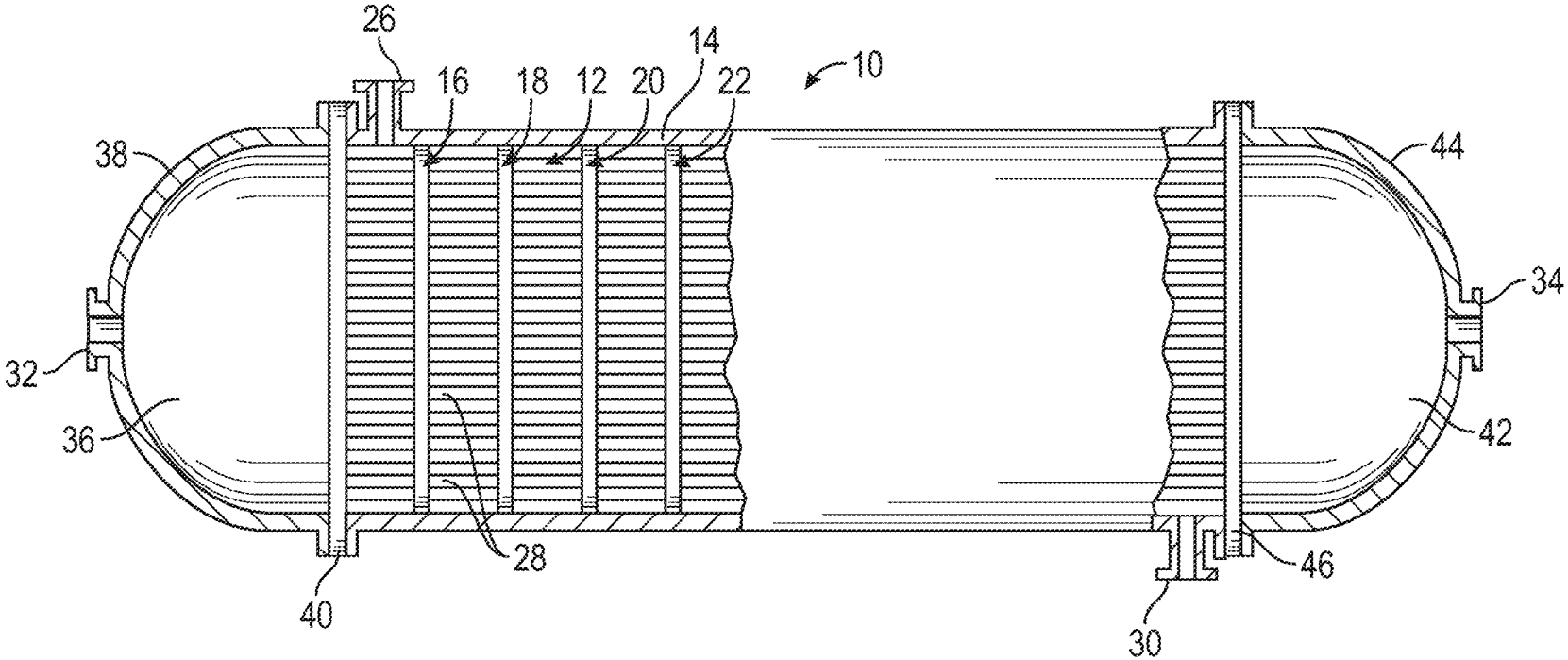
FIG. 1 (Prior Art)
FIG. 1 illustrates a side elevation view of a shell and tube heat exchanger in accordance with the prior art.

Embodiments of the present disclosure are described below in detail with reference to the accompanying figures. Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description. As used herein, the term "coupled" or "coupled to" or "connected" or "connected to" may indicate establishing either a direct or indirect connection and is not limited to either unless expressly referenced as such. As used herein, fluids may refer to slurries, liquids, gases, and/or mixtures thereof. Wherever possible, like or identical reference numerals are used in the figures to identify common or the same elements. The figures are not necessarily to scale, and certain features and certain views of the figures may be shown exaggerated in scale for purposes of clarification.

In one aspect, embodiments disclosed herein relate to a rod baffle heat exchanger for heat removal, condensation operations, electricity generation, petrochemical plants, waste heat recovery, and other industrial applications. The rod baffle heat exchanger may also be interchangeably referred to as a rod baffle condenser in the present disclosure. Additionally, the rod baffle heat exchanger may incorporate vertical baffles with vertical partition plates. The rod baffle heat exchanger may aid in the removal of polymerization heat in a cool loop. Further, the rod baffle heat exchanger may allow for a higher condensation efficiency compared to conventional condensers.

Conventional rod baffle heat exchangers in industrial applications are typically exceptionally large and heavy due to horizontal arrangement. Additionally, conventional vertical rod baffle heat exchangers use small and shorter longitudinal baffle plates. Conventional vertical rod baffle heat exchangers are not sufficient for the increased size and capacity of modern polymerization reactors. For example, conventional vertical rod baffle heat exchangers, when increased for size and capacity, may cause shutdowns due to too low of a liquid level and subsequently a short cut of vapor flow.

Accordingly, one or more embodiments in the present disclosure may be used to overcome such challenges as well as provide additional advantages over conventional rod baffle heat exchangers, as will be apparent to one of ordinary skill. In one or more embodiments, the rod baffle heat exchanger may increase a gas velocity around tubes in the rod baffle heat exchanger and increase the operational range with regards to heat exchange coefficient. Rod baffle heat exchangers, according to embodiments herein, may include prolonged baffle plates, allowing lower liquid levels to enlarge the operation range of the polymerization process. In one or more embodiments, the prolonged longitudinal baffle plates may reduce a risk of plant shutdowns during unexpected changes in cooling water temperature and allow to operate the plant with higher throughputs. The rod baffle arrangement in the heat exchanger provides improved vibration protection by the rod baffles being distributed more evenly. Additionally, the rod baffle heat exchangers may increase reliability and performance over cycles of operation. Overall, the rod baffle heat exchangers may minimize product engineering, risk associated with rod baffle manufacture, reduction of assembly time, hardware cost reduction, and weight and envelope reduction.

Rod baffle heat exchangers, according to embodiments herein, may include a number of longitudinal baffle plates to increase the vapor velocities, making the heat transfer more efficient. In a non-limiting example, the rod baffle heat exchanger may have six longitudinal baffle plates. In one or more embodiments, support for lateral and longitudinal rods of the rod baffle heat exchanger may be split and distributed more evenly to improve an anti-vibration effect. Further, a length of the longitudinal baffle plates may be increased to cover at least a full length of a U-bundle in order to increase an operational flexibility by maintaining a liquid seal even at low levels.

In one or more embodiments, the rod baffle heat exchanger may be a vertical rod baffle condenser with one or more prolonged longitudinal partition plates, such as six or more prolonged longitudinal partition plates. The prolonged longitudinal partition plates may allow a higher condensation efficiency in the vertical rod baffle condenser by increasing the gas velocity around the tubes. In addition, the prolonged longitudinal partition plates may increase the operational range with regards to heat exchange coefficient by the prolonged baffle plates, which allow lower liquid levels.

Figure 2A:
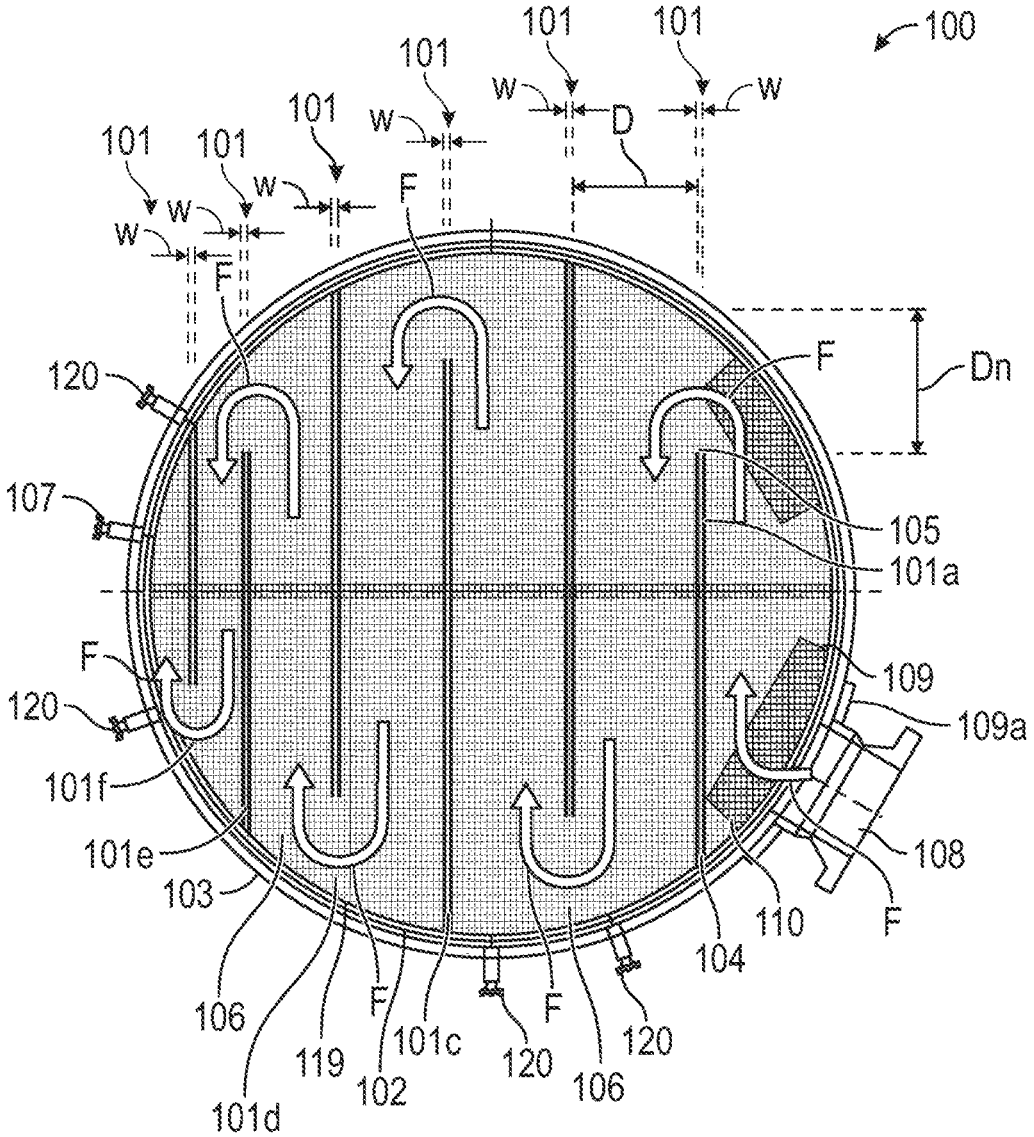
FIGS. 2A-B illustrate a top view of a rod baffle heat exchanger in accordance with one or more embodiments of the present disclosure.

Turning to FIG. 2A, FIG. 2A shows a top view of a rod baffle heat exchanger 100 in accordance with one or more embodiments of the present disclosure. The rod baffle heat exchanger 100 may include six or more longitudinal partition plates 101. The six or more longitudinal partition plates 101 may be inserted within a tube bundle 102 of the rod baffle heat exchanger 100. The tube bundle 102 is surrounded by a shell 103. A number of instrument nozzles 120 may be placed around the shell 103. The instrument nozzles 120 may provide various measurements on the rod baffle heat exchanger 100 such as level measurements, temperature measurements, and other measurements in the rod baffle heat exchanger 100. Additionally, a tube-sheet 119 may be provided on top of the six or more longitudinal partition plates 101. In one or more embodiments, a distance D between the longitudinal partition plates 101 may be varied. In a non-limiting example, the distance D between a first longitudinal partition plate 101*a* and a second longitudinal partition plate 101*b* may be greater than the distance between the second longitudinal partition plate 101*b* and a third longitudinal partition plate 101*c*. The distance between the second longitudinal partition plate 101*b* and the third longitudinal partition plate 101*c* may be greater than the distance between the third longitudinal partition plate 101*c* and a fourth longitudinal partition plate 101*d*. The distance between the third longitudinal partition plate 101*c* and the fourth longitudinal partition plate 101*d* may be greater than the distance between the fourth longitudinal partition plate 101*d* and a fifth longitudinal partition plate 101*c*. The distance between the fourth longitudinal partition plate 101*d* and the fifth longitudinal partition plate 101*e* may be greater than the distance between the fifth longitudinal partition plate 101*e* and a sixth longitudinal partition plate 101*f*. It is further envisioned that a width W of each of the longitudinal partition plates 101 may have a value between 3 to 9 mm, such as 8 mm.

Figure 2B:
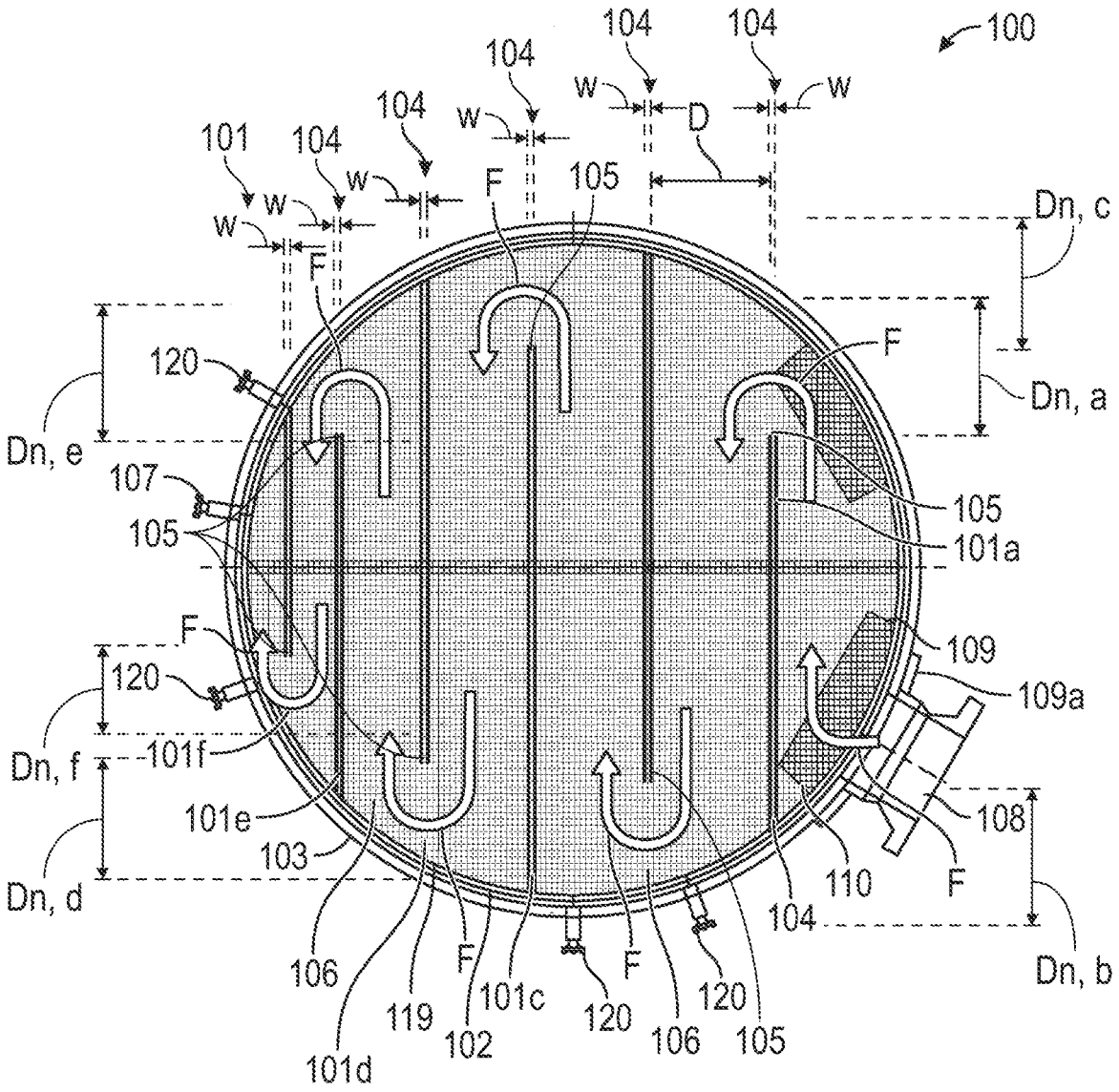

In one or more embodiments, one or more of the six or more longitudinal partition plates 101 may be a notched longitudinal partition plate 104 provided in the tube bundle 102. In one or more embodiments, as shown in FIG. 2B, each of the six or more longitudinal partition plates 101A-101F may be a notched longitudinal partition plate 104. Each of the notched longitudinal partition plates 104 may have a notched end 105 that is a vertical distance Dn from the shell 103. As shown in FIG. 2B, each of the notched longitudinal partition plates 104 may have varied vertical distances Dn,a-Dn,f. The vertical distance Dn,a-Dn,f of the notched longitudinal partition plates 104 may progressively decrease from the first longitudinal partition plate 101*a* to the sixth longitudinal partition plate 101*f*. In a non-limiting example, the vertical distance Dn,a of the first longitudinal partition plate 101*a* may be greater than the vertical distance Dn,b of the second longitudinal partition plate 101*b*. The vertical distance Dn,b of the second longitudinal partition plate 101*b* may be greater than the vertical distance Dn,c of the third longitudinal partition plate 101*c*. The vertical distance Dn,c of the third longitudinal partition plate 101*c* may be greater than the vertical distance Dn,d of the fourth longitudinal partition plate 101*d*. The vertical distance Dn,d of the fourth longitudinal partition plate 101*d* may be greater than the vertical distance Dn,e of the fifth longitudinal partition plate 101*c*. The vertical distance Dn,e of the fifth longitudinal partition plate 101*e* may be greater than the vertical distance Dn,f of the sixth longitudinal partition plate 101*f*. In some embodiments, the value of the vertical distance Dn is chosen such that there is enough area between the notched longitudinal partition plates 104 and the shell 103 for a vapor to pass into the next partition. Additionally, adjacent notched longitudinal partition plates 104 may be oriented 180 degrees such that each notched end 105 terminates the adjacent notched longitudinal partition plates 104 in an opposite direction from the shell 103.

Still referring to FIG. 2A, an outlet 107 may be provided at a similar level (circumferential location), close to the tube-sheet 119 on the shell 103, as the inlet 108. The outlet 107 may be a non-condensable gas outlet and the inlet 108 may be a vapor inlet in some embodiments. From the inlet 108, vapors may enter the rod baffle heat exchanger 100 and flow through a flow path (see block arrows F) defined by the six or more longitudinal partition plates 101 to exit through the outlet 107. Additionally, a liquid seal cylindrical section 109 may be provided below an elbow section 109*a* of the rod baffle heat exchanger 100 on the shell 103. The elbow section 109*a* may be a portion of the shell 103 forming the outlet 107 and the inlet 108. Further, an impingement plate 110 may be installed in the shell 103 to distribute incoming vapor from the inlet 108.

In some embodiments, a plurality of tubes 106 may extend in an axial direction within the tube bundle 102 such that the six or more longitudinal partition plates 101 partition the plurality of tubes 106 of the tube bundle 102. In one or more embodiments, the tube bundle 102 may be a U-tube bundle such that the plurality of tubes 106 have a bend. It is further envisioned that the notched longitudinal partition plates 104 may extend a length in a radial direction such that the notched end 105 is within the tube bundle 102 (see, for example, FIG. 3C). The radial length of the notched longitudinal partition plates 104 may be measured from an end attached to the shell 103 to the notched end 105. A minimum longitudinal length of the notched longitudinal partition plates 104 is greater than a lowest point at which a tube 106 is provided in the U-tube bundle 102. By extending the notched longitudinal partition plates 104 in a longitudinal direction to at least the end of the U-tube bundle (see FIG. 3C), a lower liquid seal is achieved and an operating range of the rod baffle heat exchanger 100 is increased.

Figure 3A:
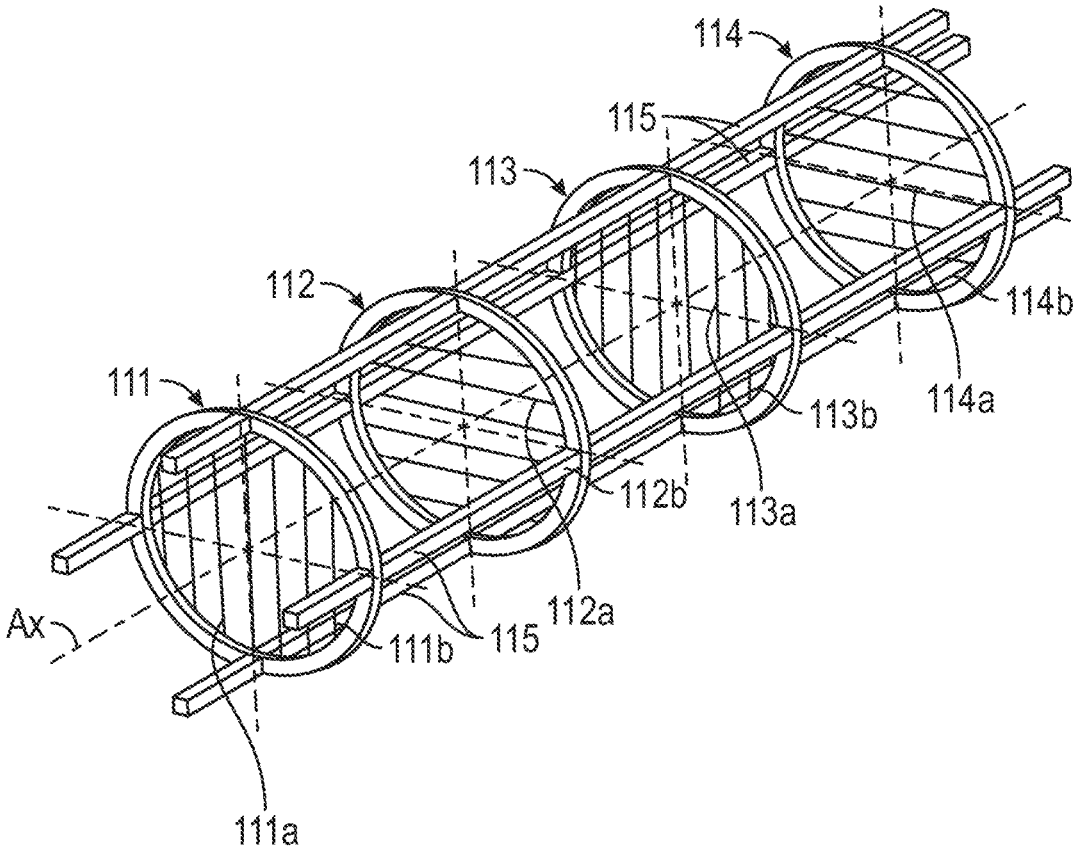
FIGS. 3A-C illustrate a perspective view of a plurality of rod baffle rings of a rod baffle heat exchanger in accordance with one or more embodiments of the present disclosure.

As shown in FIG. 3, in one or more embodiments, the rod baffle heat exchanger 100 may include a plurality of rod baffle rings 111, 112, 113, 114 distributed along an axial axis Ax of the plurality of tubes (see 106 in FIG. 2). For example purposes only, FIG. 3 is shown with four rod baffle rings 111, 112, 113, 114; however, the rod baffle heat exchanger 100 may have any number rod baffle rings without departing from the scope of the present disclosure. Additionally, a plurality of support bars 115 may be arranged on a circumference of the shell (see 103 in FIG. 2), which may be used to fix the tube bundle (see 102 in FIG. 2) and function as a slideway for the plurality of rod baffle rings 111, 112, 113, 114. In a non-limiting example, the rod baffle heat exchanger 100 may have four support bars 115 evenly spaced such that the support bars 115 may be in 90-degree increments around a circumference of the plurality of rod baffle rings 111, 112, 113, 114.

In one or more embodiments, the plurality of rod baffle rings 111, 112, 113, 114 may be provided in sets of four. The plurality of rod baffle rings 111, 112, 113, 114 may be in a configuration to have each rod baffle ring rotated at 90-degrees from an adjacent rod baffle ring. By staggering the plurality of rod baffle rings 111, 112, 113, 114 at 90 degrees back and forth, the rod baffle heat exchanger 100 may eliminate a phenomenon of liquid accumulation and realize a high-flux flow of condensate on the plurality of tubes (see 106 in FIG. 2). In a non-limiting example, the first rod baffle ring 111 in the set of four rod baffle rings may have a plurality of lateral rod baffles 111*a* extending from an inner surface 111*b* of the first rod baffle ring 111. The second rod baffle ring 112 in the set of four rod baffle rings may have a plurality of longitudinal rod baffles 112*a* extending from an inner surface 112*b* of the second rod baffle ring 112. The third rod baffle ring 113 in the set of four rod baffle rings may have a plurality of lateral rod baffles 113*a* extending from an inner surface 113*b* of the third rod baffle ring 113. The fourth rod baffle ring 114 in the set of four rod baffle rings may have a plurality of longitudinal rod baffles 114*a* extending from an inner surface 114*b* of the fourth rod baffle ring 114.

Figure 4A:
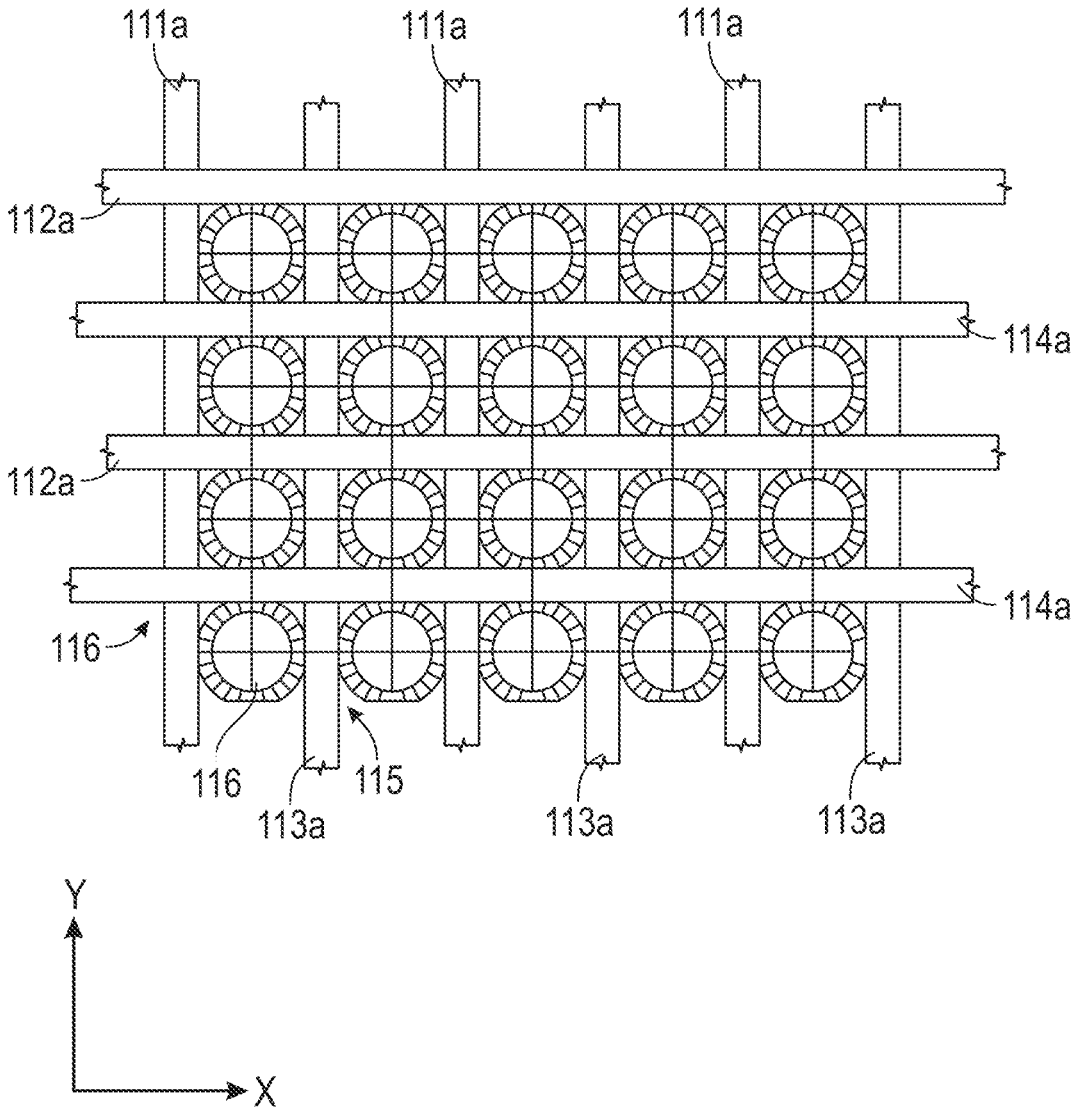
FIG. 4 illustrates a partial close-up top view of a plurality of tubes of a rod baffle heat exchanger in accordance with one or more embodiments of the present disclosure.

Now referring to FIG. 4, in one or more embodiments, FIG. 4 shows a partial close-up top view of the plurality of tubes 106 being spaced by the lateral rod baffles 111*a*, 113*a* of the first and third rod baffle rings 111, 113 and the longitudinal rod baffles 112*a*, 114*a* of the second and fourth rod baffle rings 112, 114.

Figure 3B:
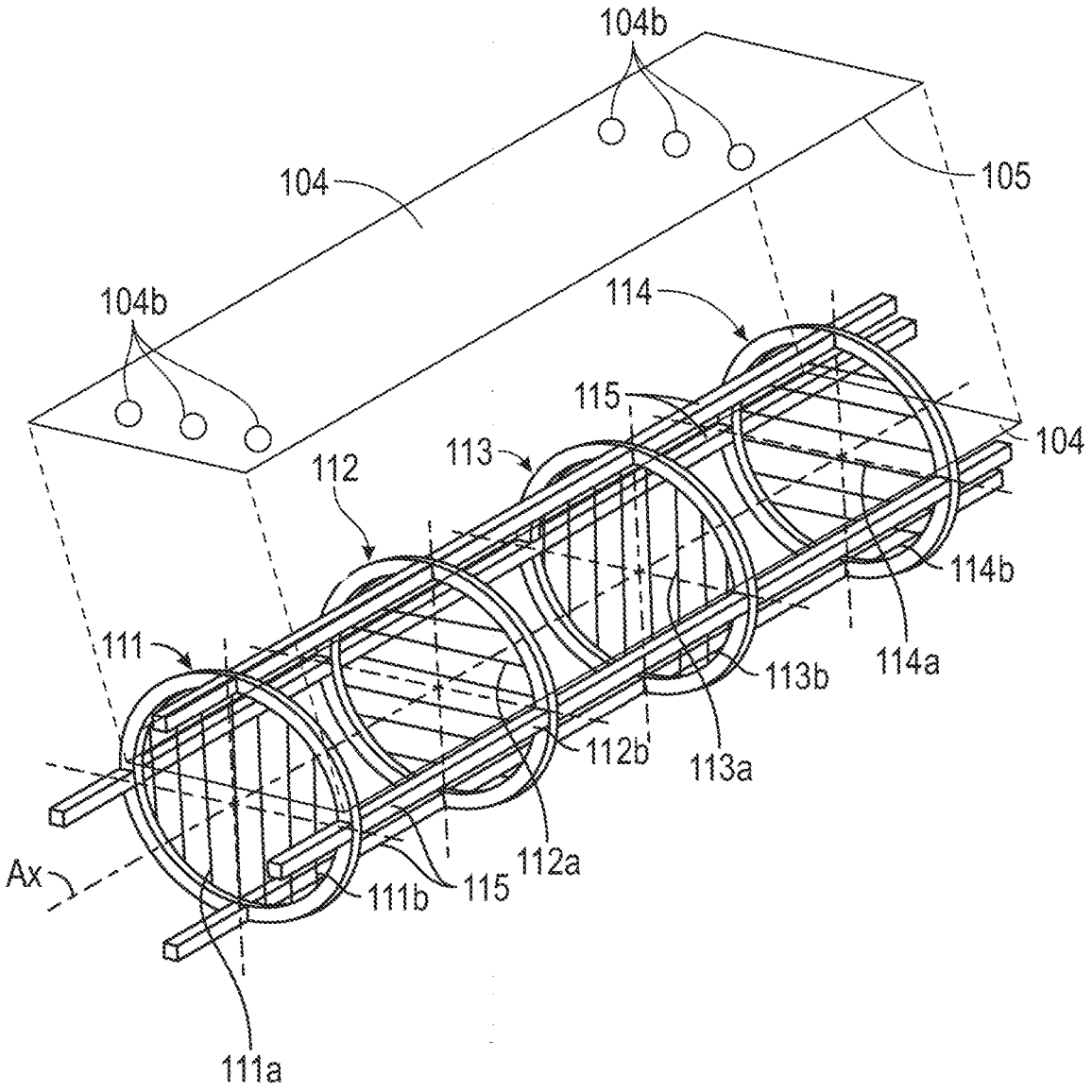
Figure 3C:
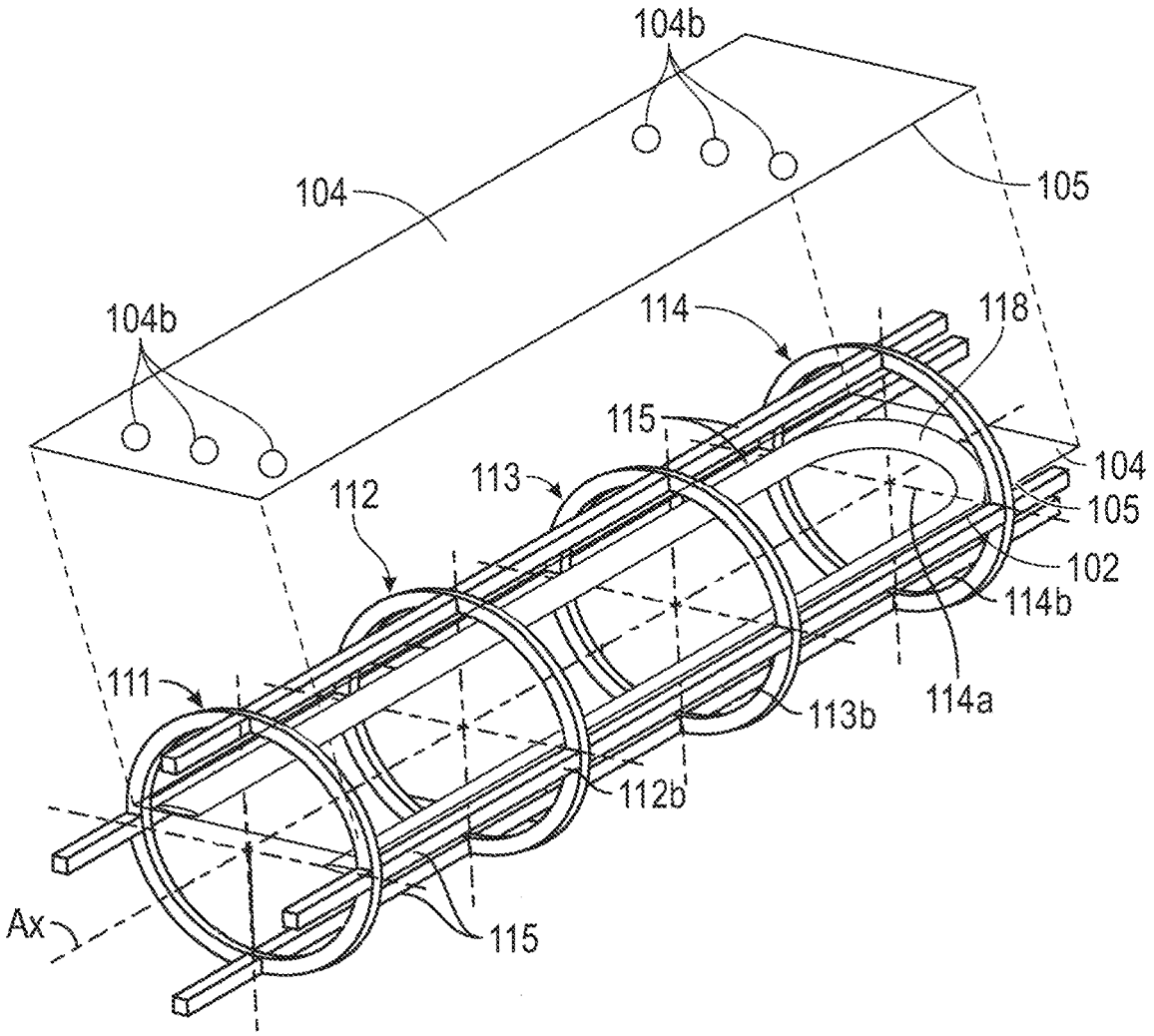

As shown in FIG. 4, the lateral rod baffles 111*a*, 113*a* pass through a gap 115 between adjacent tubes (106) in the X axis direction. The longitudinal rod baffles 112*a*, 115*a* pass through a gap 116 between adjacent tubes (106) in the Y axis direction. Additionally, as shown in FIG. 3B, the lateral rod baffles 111*a*, 113*a* may also pass through openings in the notched longitudinal partition plates. By increasing a distance between the lateral and longitudinal rods, the flow of liquid condensate in the plurality of tubes 106 may be less restricted and the support of the plurality of tubes 106 may be more evenly distributed over the length of the plurality of tubes 106.

Figure 5:
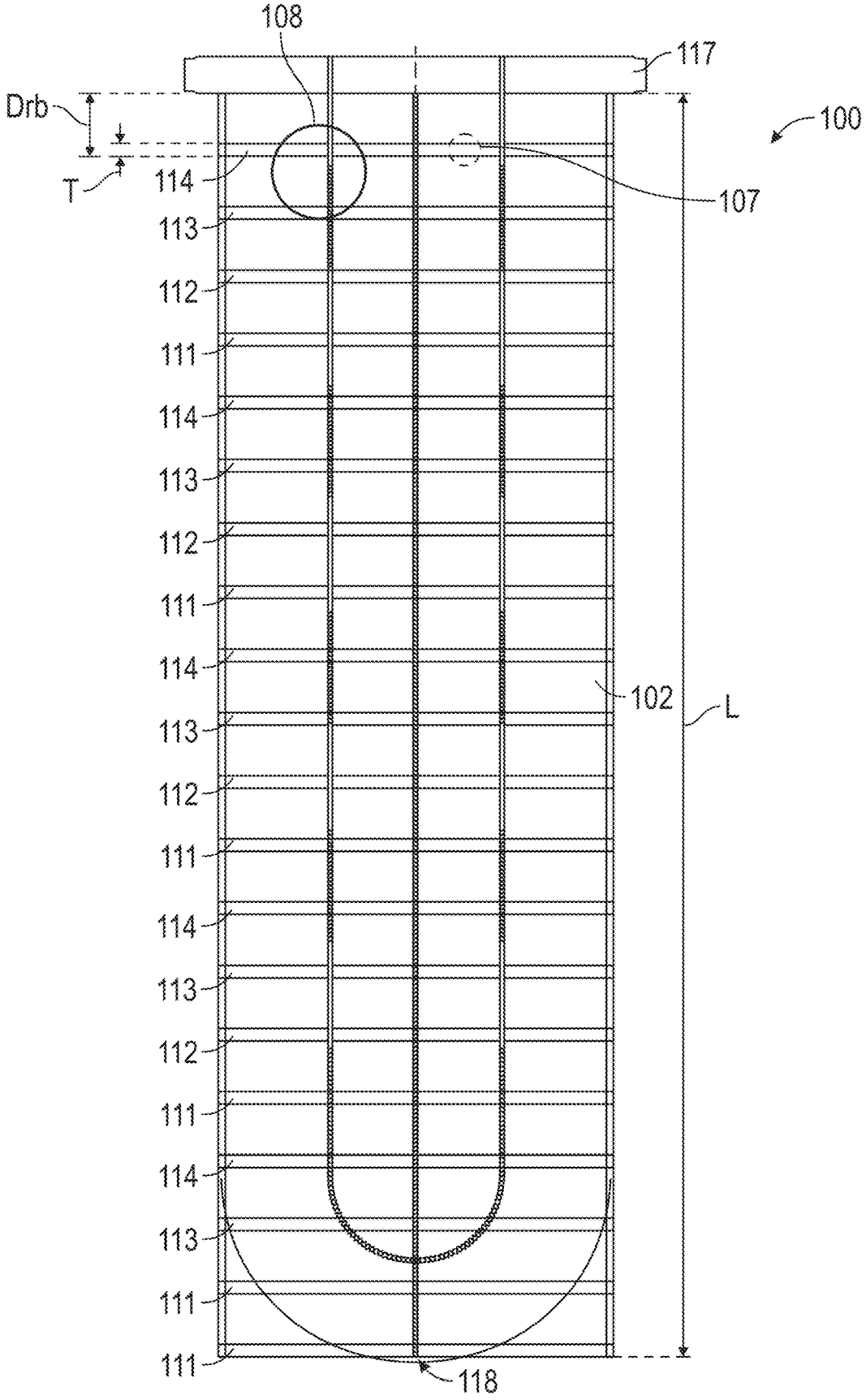
FIG. 5 illustrates a partial view of a rod baffle heat exchanger in accordance with one or more embodiments of the present disclosure.

Now referring to FIG. 5, in one or more embodiments, FIG. 5 shows a partial view of the rod baffle heat exchanger 100. As shown FIG. 5, the plurality of tubes 106 may be in the tube bundle 102 such as a U-tube bundle extending a length L. One skilled in the art will appreciate how the U-tube bundle 102 allows the plurality of tubes 106 to bend, e.g., U-bend 118, such that full length of the plurality of tubes 106 is greater than the length L of the U-tube bundle 102. This allows the rod baffle heat exchanger 100 to have longer tubes 106 while remaining compact and decrease the overall footprint of the rod baffle heat exchanger 100. Additionally, the inlet 108 is in an upper part on a front side of the tube bundle 102 while the outlet 107 is on a back side of the tube bundle 102. It is further envisioned that the outlet 107 may have a smaller diameter than the inlet 108.

As shown in FIG. 5, in one or more embodiments, the rod baffle heat exchanger 100 may have 4 sets of the set of four rod baffle rings 111, 112, 113, 114 as described in FIG. 3 such that there are 8 sets of the rod baffle rings with lateral rods and 8 sets of the rod baffle rings with longitudinal rods. In addition, the rod baffle heat exchanger 100 may include a fifth set of four rod baffle rings configured with two first rod baffle rings such that the order of rod baffle rings is 111, 111, 113, 114, accounting from a U-bend 118 in the U-tube bundle 102. It is further envisioned that a low point of the U-bend 118 may match a lowest rod baffle ring in the rod baffle heat exchanger 100. Each of the rod baffle rings 111, 112, 113, 114 may be spaced a distance Drb from an adjacent rod baffle such the rod baffle rings 111, 112, 113, 114 are evenly spaced across the length L of the U-tube bundle. Additionally, each of the rod baffle rings 111, 112, 113, 114 may have a thickness T such that the rod baffle rings have a uniform thickness. It is further envisioned that a rear part 117 of the U-tube bundle may have an anti-vibration grid structure.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

The invention claimed is:

1. A rod baffle heat exchanger comprising:

a shell;

a tube-sheet;

a tube bundle having a plurality of heat exchange tubes extending in an axial direction of the shell, wherein the tube bundle is a U-tube bundle comprising a U-bend in the plurality of heat exchange tubes;

six or more longitudinal partition plates, each plate having a first end attached to the shell and each extending towards an opposing side of the shell, wherein at least one of the six or more longitudinal partition plates is a notched longitudinal partition plate having a notched second end at a distance $D_n$ from the shell; and a plurality of rod baffle rings provided and spaced from each other along an axial length of the plurality of heat exchange tubes, wherein each of the plurality of rod baffle rings either has lateral rod baffles extending from an inner surface of the rod baffle ring to an opposite inner surface of the rod baffle ring or has longitudinal rod baffles extending from an inner surface of the rod baffle ring to an opposite inner surface of the rod baffle ring, wherein the lateral rod baffles and the longitudinal rod baffles are perpendicular to each other and to the axial direction of the shell, wherein the lateral rod baffles and the longitudinal rod baffles pass through gaps between every two adjacent tubes of the plurality of heat exchange tubes, and the lateral rod baffles further pass through openings in the notched longitudinal partition plates, and wherein the at least one notched longitudinal partition plate extends length in the longitudinal direction of the shell from the tube sheet to at least a lowest point of the U-tube bundle at which a tube of the plurality of heat exchanges tubes is provided in the U-tube bundle, and wherein the at least one notched longitudinal partition plate extends a length toward the opposite side of the shell such that the notched second end is located within the U-tube bundle.

2. The rod baffle heat exchanger according to claim 1, further comprising a plurality of support bars arranged on a circumference of the shell adapted to fix the tube bundle.

3. The rod baffle heat exchanger according to claim 2, wherein the plurality of support bars are spaced apart from each other and rotated in 90-degree increments around a circumference of the plurality of rod baffle rings.

4. The rod baffle heat exchanger according to claim 1, further comprising a non-condensable gas outlet and a vapor inlet.

5. The rod baffle heat exchanger according to claim 4, further comprising a liquid seal cylindrical section.

6. The rod baffle heat exchanger according to claim 4, further comprising an impingement plate provided in the shell to distribute incoming vapor from the inlet.

7. The rod baffle heat exchanger according to claim 1, wherein the plurality of rod baffle rings comprises a set of four rod baffle rings:

a first rod baffle ring having a plurality of lateral rod baffles extending from an inner surface of the first rod baffle ring, a second rod baffle ring having a plurality of longitudinal rod baffles extending from an inner surface of the second rod baffle ring, a third rod baffle ring having a plurality of lateral rod baffles extending from an inner surface of the third rod baffle ring, and a fourth rod baffle ring having a plurality of longitudinal rod baffles extending from an inner surface of the fourth rod baffle ring.

8. The rod baffle heat exchanger according to claim 7, further comprising at least four sets of four rod baffle rings.

9. The rod baffle heat exchanger according to claim 8, further comprising a fifth set of four rod baffle rings comprising two of the first rod baffle rings, the third rod baffle ring, and the fourth rod baffle ring.

10. The rod baffle heat exchanger according to claim 1, wherein a width of each of the longitudinal partition plates is between 3 millimeters and 9 millimeters.

11. The rod baffle heat exchanger according to claim 1, wherein a distance between the longitudinal partition plates and a length of the at least one notched longitudinal partition plates are varied.

12. The rod baffle heat exchanger according to claim 11, wherein:

a distance between a first longitudinal partition plate and a second longitudinal partition plate is greater than a distance between the second longitudinal partition plate and a third longitudinal partition plate, the distance between the second longitudinal partition plate and the third longitudinal partition plate is greater than a distance between the third longitudinal partition plate and a fourth longitudinal partition plate, the distance between the third longitudinal partition plate and the fourth longitudinal partition plate is greater than a distance between the fourth longitudinal partition plate and a fifth longitudinal partition plate, and the distance between the fourth longitudinal partition plate and the fifth longitudinal partition plate is greater than a distance between the fifth longitudinal partition plate and a sixth longitudinal partition plate.

13. The rod baffle heat exchanger according to claim 12, wherein the notched end of each notched longitudinal partition plate is a distance from the shell, wherein the distance from the shell decreases from the first longitudinal partition plate to the sixth longitudinal partition plate.

* * * * *